US007172456B1

(12) United States Patent
Nagy

(10) Patent No.: US 7,172,456 B1
(45) Date of Patent: Feb. 6, 2007

(54) ELECTRIC CABLE ORGANIZING APPARATUS

(76) Inventor: Jeffery Nagy, 12 Half Penny La., Old Saybrook, CT (US) 06475

( * ) Notice: Subject to any disclaimer, the term of this patent is extended or adjusted under 35 U.S.C. 154(b) by 0 days.

(21) Appl. No.: 11/439,051

(22) Filed: May 23, 2006

Related U.S. Application Data

(60) Provisional application No. 60/684,876, filed on May 26, 2005.

(51) Int. Cl.
*H01R 13/72* (2006.01)

(52) U.S. Cl. ..... 439/501; 439/4; 174/135

(58) Field of Classification Search ..... 439/501, 439/4, 371, 450, 650; 174/135
See application file for complete search history.

(56) References Cited

U.S. PATENT DOCUMENTS

| | | | | |
|---|---|---|---|---|
| 2,746,112 | A * | 5/1956 | Simon | 24/129 B |
| 3,257,497 | A * | 6/1966 | Chase | 174/66 |
| 3,290,453 | A | 12/1966 | Jensen | 191/12.4 |
| 4,072,401 | A | 2/1978 | Instone | 339/125 R |
| 4,353,613 | A | 10/1982 | Carlow | 339/119 |
| 4,500,150 | A * | 2/1985 | Leibensperger et al. | 439/502 |
| 4,705,342 | A * | 11/1987 | Schwartz | 439/650 |
| 5,516,298 | A | 5/1996 | Smith | 439/131 |
| 5,961,081 | A * | 10/1999 | Rinderer | 248/68.1 |
| D428,598 | S | 7/2000 | Carter-Williams et al. | D13/154 |
| D434,002 | S | 11/2000 | Rossman et al. | D13/139.6 |
| D445,766 | S | 7/2001 | Solomon | D13/199 |
| 6,471,542 | B1 * | 10/2002 | Comer | 439/501 |
| 6,503,097 | B2 * | 1/2003 | Archambault | 439/501 |
| 6,523,229 | B2 * | 2/2003 | Severson | 24/16 PB |
| 6,581,885 | B2 | 6/2003 | Polad | 248/74.3 |
| D491,535 | S | 6/2004 | Chien | D13/154 |

* cited by examiner

*Primary Examiner*—Hae Moon Hyeon
(74) *Attorney, Agent, or Firm*—C. Nessler

(57) ABSTRACT

An electric cable organizing device is comprised of at least one, preferably a pair, of brackets to which is attached an electric outlet strip, such as a power strip which receives the plug ends of electric cords. An outlet strip is attached to two spaced apart brackets which are attached to a vertical surface and which extend transversely from at least one side of the strip. Each bracket has an associated strap, such as an elastomer o-ring, that runs across the bracket surface, from proximity of the outlet strip to a spaced apart fastener on the bracket surface. The excess lengths of cords which run from outlets of the outlet strip run zigzag in the space between the brackets and are held neatly in place against the surface of each bracket by the straps.

19 Claims, 4 Drawing Sheets

ELECTRIC CABLE ORGANIZING APPARATUS

This application claims benefit of provisional patent application Ser. No. 60/684,876, filed, May 26, 2005.

TECHNICAL FIELD

The present invention relates to bundling and support devices of the type which bundles and holds the excess lengths of cords running to an electric power supply outlet of other type of electric outlet in an organized manner.

BACKGROUND

In recent years, there has been a proliferation of electronic and computer devices for the office and home. Having such devices may make things easier, quicker and more entertaining, as the case may be. But it has also led to a tangle of electrical power cords and cables. That is particularly the case for desk-top computer systems which have many separate units which are connected together by cables, and many separate units which have individual power cords. A tangle of cords and cables can be unsightly. It can also create the danger in that a person will trip over them, that a small child may become entangled, or that a person, child or a pet would inadvertently engage them and pull things off tables or shelves and onto themselves.

Power strips, that is, devices which have a multiplicity of electric power outlets, can be used in an attempt to minimize the number of cords running to a wall outlet. But, the strips themselves are often quite bulky, relatively unsightly, and possibly present an even larger tripping hazard to persons than do the cords and cables which run to them. Also, the lengths of cords from different devices may be different and in some cases too long, leading again to tangles or skewed wires.

Cables and cords can be bundled and secured with rubber bands, twist ties, and ratcheting and self-locking plastic ties. But those can be of limited success, in that the resultant bundles typically remain on the floor, thus possibly creating a tripping hazard. Many of the means by which cables and the like may be bundled do not easily attach to walls, baseboards, and desks, to lift bundles off the floor or table; or when they do so attach, they do not readily accept removal of individual cables or insertion of new cables.

Thus, there is a need for apparatus for securing and organizing cables and wires that can overcome the above-mentioned and other disadvantages of the prior art approaches.

SUMMARY

An object of the invention is to provide means for neatly securing and organizing cords, particularly electric power cords which are used with desk and table top devices. A further object is to provide apparatus for securing cords against a wall or other flat surface, which means is economic to manufacture and compact for shipment.

In accord with the invention an electric cord organizing apparatus comprises an oblong shape outlet strip which has a plurality of outlets for receiving the terminal ends of electric cords.

The outlet strip is mounted on two spaced apart brackets, each of which is attached to a planar surface such as a wall with a spacing suited for fitting the mounting slots on the rear of an outlet strip. Each bracket extends transversely from at least one side of the outlet strip, optionally from both sides; and, each bracket has at least one associated strap for securing cords, which run from the outlets, to the surface of the bracket, which cords run back and forth in zigzag fashion adjacent the mounting strip. Ordinarily, but not necessarily, the cords secured by the straps will those that connect to the outlets, but other cords may be captured as well.

In one embodiment, each bracket has a member which is a headed pin which fits into the slot on the rear of a common outlet, for instance into a common outlet strip used for providing domestic electric power to electric devices. The strap, preferably an elastomer o-ring, runs from the headed pin to another fastening means, for instance another member which is a projecting headed pin, which is located near the outer end of the transversely extending bracket. Preferably, at least one end of each strap is detachable from its fastening means so, that cords can be thereby captured beneath the strap. Alternately, the resilience of the strap is such that it can be pulled away without being detached, to enable placement of the excess cord lengths.

In other embodiments, straps may be non-elastic material; and the strap fastening means proximate the outlet strip mounting may be independent of the means for attaching the outlet strip to the bracket.

The brackets and straps may be provided in kit form with or without an outlet strip. Since the brackets are separate, they can be mounted in spaced apart fashion, to fit the slot openings of any outlet strip. In other embodiments, the brackets may be permanently attached to the outlet strip.

The foregoing and other objects, features and advantages of the present invention will become more apparent from the following description of preferred embodiments and accompanying drawings.

DESCRIPTION

The invention is primarily described in terms of securing and organizing power cords, such as the kind of transmission lines used to deliver domestic alternating current electric power to computer devices, printers, copiers, and the like. In the embodiments illustrated here, the power transmission lines plug into a power strip. The power strip is a familiar commercial device having at least one, most commonly a multiplicity of linearly-adjacent, female outlets, each shaped to receive the male or plug end of an electric power cord. In the U.S. a 110 volt AC power cord plug has two spaced part parallel blades, often also with a semi-round ground pin. In the generality of the invention, other outlet strips than power strips may be used, and other kinds of transmission lines, having terminal ends analogous to the plugs of AC power lines, will be received and secured. For instance, the outlet strips and lines may be such as those relating to coaxial cables, telephone lines, or high speed data transmission lines. In the description and claimed invention it will be understood that the term cord is meant to include any kind of electric transmission line which has at its terminal end a fitting for detachable connection to an outlet strip. By outlet strip is meant any rigid body having one or more fitting for receiving the end of transmission line in disconnectable fashion.

Figure 1:
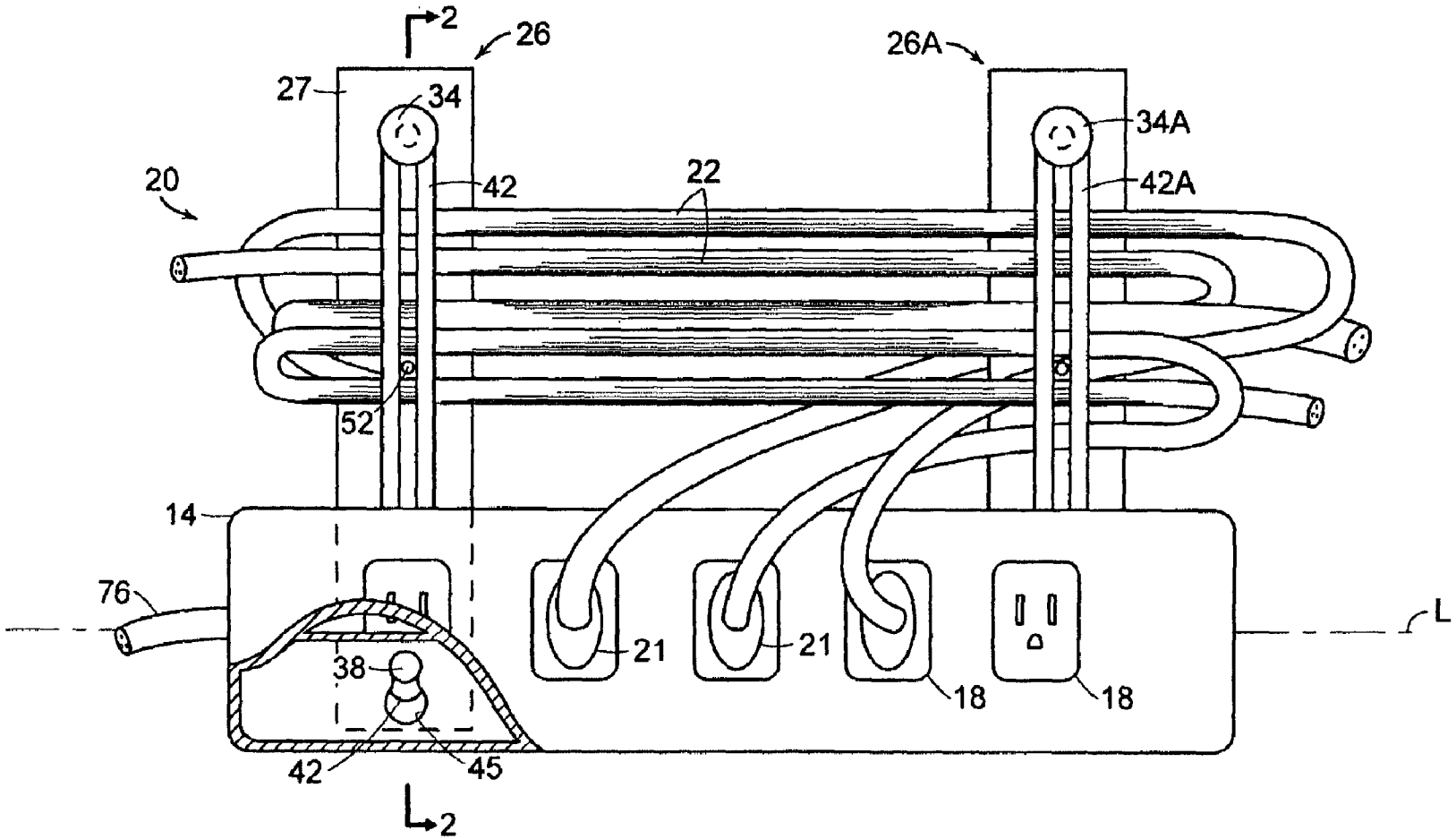
FIG. 1 is a front view of a cable organizing apparatus.
Figure 2:
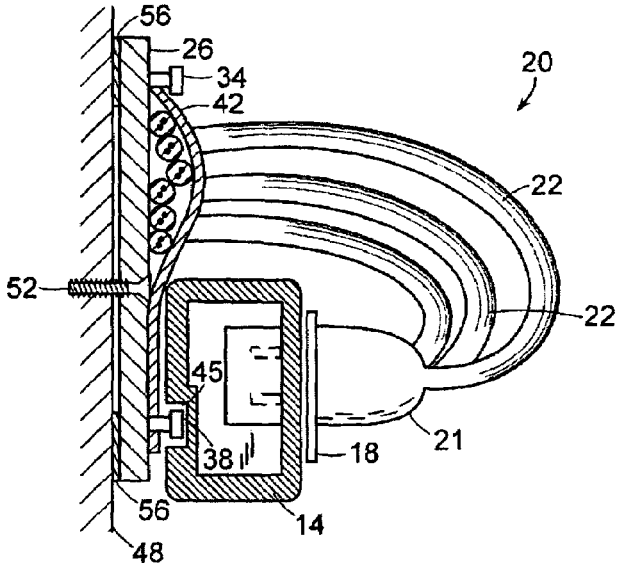
FIG. 2 is a side cross-sectional view of the cable organizing apparatus of FIG. 1.

FIG. 1 is a front view and FIG. 2 is a side cross section view of an embodiment of cable organizing apparatus 20 with cables. Rectanguloid power strip 14 is attached at each end to spaced apart brackets 26, 26A, which brackets have been fastened to a wall or other vertical surface, such as the side of a desk or bookcase. Outlet strip 14 includes an integral cord 76 for carrying electric power or signals to the outlets 18. Preferably, as shown, each bracket has a cantilever pin 38, 38A. The pins have heads, like the heads of flat head screws. In this embodiment, the power strip is attached to each bracket by slipping one of opposing-end rear-side slotted holes 45, 45A (each having a familiar "keyhole" shape) onto the pins 34, 34A of a spaced-apart bracket pair. When a strap is captured on the pin between the back of the outlet strip and the surface of the bracket, as described below, the exposed length of the screw under the head must be sufficient to accommodate both the thickness of the strap and the thickness of the rear wall of the outlet strip.

A feature of this aspect invention is that a variety of power strips may be used in the apparatus, since the brackets can be spaced part to fit the keyhole spacing of power strips from different manufacturers. Thus, in one approach, brackets and straps may be provided to a user who already has a power strip.

A plurality of outlets 18 lies along the length of the oblong power strip 14 which has a length axis L. In the Figures, the terminal ends (or "plugs") 21 of three of electrical cords 22 are inserted into power outlets 18, to illustrate how the invention works. The cords 22 run back and forth beneath the straps 42 and are neatly secured. The cords are not elements of the essential apparatus of the invention.

Power strip 14 is attached to a first bracket 26 and a second bracket 26A by means of the aforementioned pins, or by other means described below. The brackets are affixed to a wall 48 (which wall is illustrated only in FIG. 2). In this and other embodiments the lengths of the brackets 26, 26A run vertically while the power strip body length runs horizontally, and thus perpendicularly to the brackets. As mentioned below, there may be other configurations in the generality of the invention.

Figure 3:
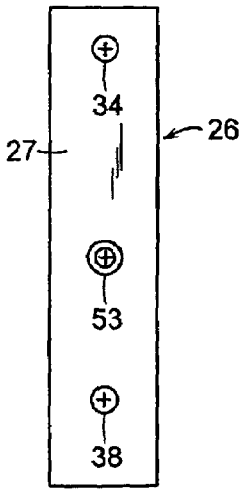
FIG. 3 is a front view of a bracket.

Preferably, but not necessarily, the brackets are identical, as illustrated. Similar features on brackets are designated by similar numbers with suffixes. In the following, a single bracket is described by example. Typical bracket 26 is comprised of an elongate body 27. Members, upper pin 34 and lower pin 38, project from the surface of the body to provide a means for fastening the strap. FIG. 3 is a front view and FIG. 4 is a side view of typical bracket 26, showing the pins 34, 38 along with optional screw hole 53, through which a screw may be passed, to attach the bracket to a surface.

In this embodiment of the invention, each bracket has an associated strap 42 which runs through space from the pin which holds the power strip to another pin 34, 34A near the top of the bracket. The straps hold the excess lengths of cords 22 against the bracket surfaces. As best illustrated by FIG. 1, cords 22 are arranged by the user so they run generally transversely across the surfaces of brackets 26, 26A, in back and forth or zigzag fashion in the space between the brackets, according to the amount of excess in each cord's length. Strap 42 is preferably a stretchable o-ring, i.e., an endless loop, made of elastomer. The o-ring shape strap 42 runs around the pin sets 38 and 34, and is captured beneath the heads of the pins. An o-ring strap has the advantage of concentrating the holding force and applying it along two closely spaced line contacts, so the effect of local irregularities in the cord surfaces is minimal. To position the cords neatly, the user may detach the top end of a strap, run the cords and then re-attach the upper end of the strap. Alternately, especially when the straps are the preferred elastic or stretchable material, the cords may be inserted under the straps without detaching them, by manually lifting a strap up and away from the bracket surface. Preferably, a fastening means is a member which projects from the surface of the bracket, as does the headed pin. Different fastening means are described below.

Figure 4:
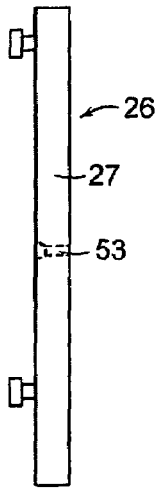
FIG. 4 is a side view of the bracket of FIG. 3.

As illustrated in FIGS. 2, 3 and 4, bracket 26 may be attached to a vertical surface 48 by means of a screw 52 passed through hole 53 in body 27 of the bracket; and as shown in FIG. 2, the screw may be used in combination with pieces of double sided adhesive tape 56. Only one of the two means, screw(s) or adhesive, may be used. Alternatively, a bracket may be attached to a surface or object by other means, such as bolts, nails, adhesives, snap fasteners, etc.

Figure 5:
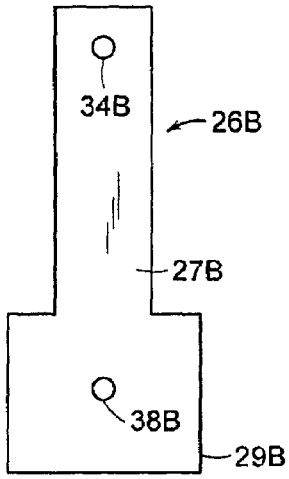
FIG. 5 is a front view of an alternative embodiment bracket.

FIG. 5 shows alternative embodiment bracket 26B which has a narrow upper portion and wider bottom portion 29B. The greater surface area of the bottom portion increases resistance to twisting under sideways loads on bracket, and provides more gripping area when double sided adhesive tape and other adhesive is used to mount the bracket on a surface.

Figure 13:
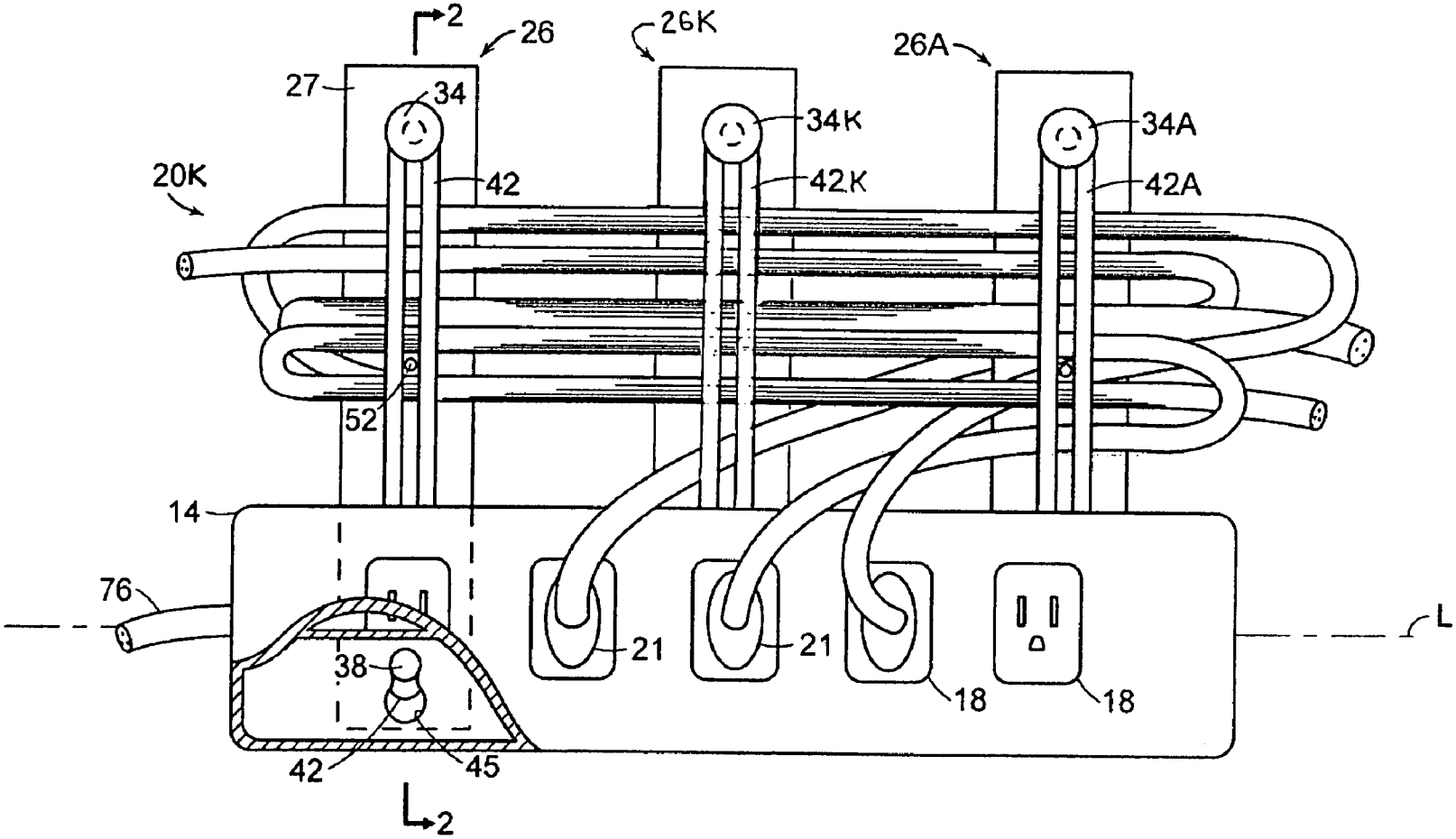
FIG. 13 is like FIG. 1 with addition a third bracket and strap.

While brackets are preferably substantially flat and rectangular plates which have been described, alternative brackets may be thicker, may be hollow, and or may have contoured surfaces. See the description relating to FIG. 8. Both brackets are preferably identical, but alternatively they may have non-identical configurations. While two brackets are shown and preferred one or more additional brackets may be used in any of the claimed embodiments of the invention. As an example, FIG. 13 shows an assembly 20K which is like that of FIG. 1, with addition of third bracket 26K, having an associated pin 34K and strap 43K. In the alternative only one bracket may be used. See below.

In alternative embodiments of the invention, brackets may run on the mounting surface at angles which are other than vertical and they may be unparallel. Brackets run transversely to the power strip length but in the invention they need not be perpendicular to it. As a particular example of an alternative, the power strip may run nominally vertically and the brackets may run nominally horizontally. While the cords preferably run back and forth above a horizontal power strip, they may run back and forth beneath a horizontal power strip.

Figure 6:
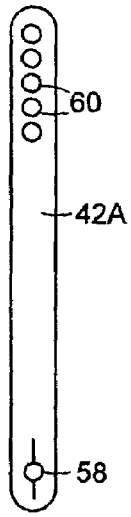
FIG. 6 is a front view of an alternative embodiment strap.

As described for strap 42, a strap is preferably made of resilient elastomer material that is attachable to the upper and lower pins of the bracket. Less preferably, the strap may be made of a non-stretchable material. For example, FIG. 6 shows in front view a thermoplastic (e.g., polyethylene or nylon) strip 42A having a hole 58 for attachment to pin 38 and a series of lengthwise spaced apart holes 60, which allows selective attachment to top pin 34, according to the size of the bundle of cords which is captured. As illustrated for the bottom hole 58, the holes may be partially or wholly slits. In each instance, the hole has a diameter and or slit length sufficient to let it be pressed over the top of a headed pin or other attachment means. In another embodiment, not shown, the end of the elastic strap comprises a metal or plastic ring which slips over the upper pin. In still another embodiment a familiar hook and loop (Velcro™) type fastener may be used, where the joint between the pieces is made in space above the cord bundle, or at the upper end. See also the description of FIG. 12

In the preferred embodiment, the bottom of a strap will not ordinarily be detached from the bracket, to enable inserting or removing one or more of the cords from its captured position. But when the power strip and the bottom end of the strap may be detached from the bracket, as in the embodiments described above, it makes convenient relocation or replacement of the power strip or a strap. If such replacement option is not wanted, the bottom portion of the strap may be permanently attached to the bracket, as by a rivet or adhesive. In still another embodiment, the power strip may be permanently attached to a bracket(s), either independently from the strap, or in combination with capture of the strap. An outlet strip may be permanently attached to one or both of the brackets by welding, adhesive bonding or other means at the factory or point of use, for example, for carrying out the embodiments shown in FIG. 7 and FIG. 9.

Figure 7:
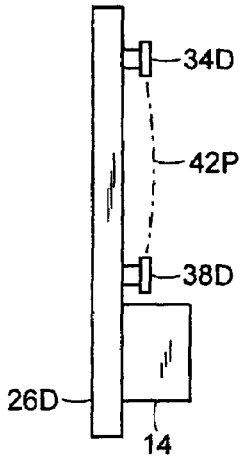
FIG. 7 through FIG. 9 are side elevation views of brackets with attached outlet strips, showing alternative strap path configurations.
Figure 8:
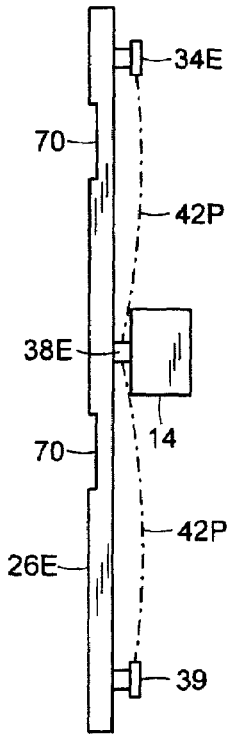
Figure 9:
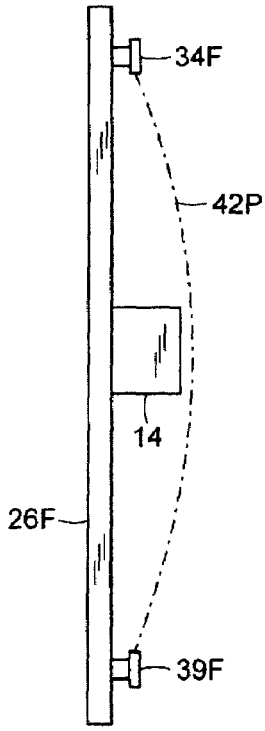

Preferably, each bracket will have two spaced part pins, one for receiving a power strip and lower end of the strap, and one for attachment of the upper end of the strap. FIGS. 7 through 9 are simplified views like FIG. 2, which illustrate some different embodiments. Numbers with suffixes correspond with prior elements. In each view, the path(s) of a strap(s) is shown by means of the dashed line 42P. In FIG. 7 the power strip 14 is welded or otherwise attached to the typical bracket 26D. The lower most pin 38D is mounted in close proximity to the power strip. (Pin 38 of bracket 26 in FIG. 1 and FIG. 2 is also within "close proximity to power strip" 14, since it is underlies the strip.) In FIG. 8, bracket 26E extends transversely, i.e., it runs up and down in the picture, from both sides of the power strip 14. A third lowermost pin 39 enables the running of two straps, to capture cords both above and below the bracket. In an alternate embodiment, the portion of bracket 26E which extends from one side of the power strip may have no strap while the other side has one as shown. Such increased length bracket would provide more area for attachment and more stability to the apparatus, compared to a bracket extending from only one side. FIG. 8 also illustrates that the back side of a bracket may have cutouts 70 and other surface features, and that a bracket only need be substantially planar on its rear side, for attaching to a planar surface. In the FIG. 9 embodiment, power strip 14 is attached to the center of bracket 26F; and, strap path 42P runs from upper pin 34F, across the power strip, to lower pin 39F.

The brackets and straps may be sold in kit form, so that the end user may use an outlet strip of the user's choice. Alternately, the seller may provide an outlet strip with one or two or more brackets and straps.

Figure 10:
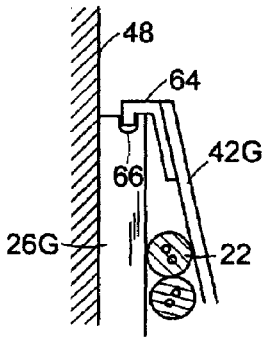
FIG. 10 is a side elevation view showing an alternative means of fastening the end of a strap to the end of a bracket.
Figure 11:
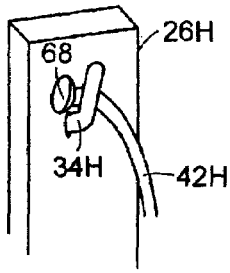
FIG. 11 is a partial isometric view of the ball end of a strap engaged with a catch at the end an alternative embodiment bracket.

FIGS. 10 and 11 illustrate some further alternative types of straps and their fastening means. In FIG. 10, the top end of bracket 26G has a slot 66. The end 64 of elastic flat strap 42G is an L-shape plastic or metal clip 64 which is attached to the strap. The end of clip 64 fits into the slot when the strap is stretched, and the clip is held in place by elastic tension in the strap.

In FIG. 11 a round elastic strap 42H has a ball end 68 which is captured within the vee-shape slot or crevice between bent pin 34H and the surface of the bracket 26H. It will be appreciated that other structure may be used to define a slot or groove that is shaped to capture the end of a strap, with or without a ball end. In still another embodiment, not shown, the strap is substantially inelastic, for example it is a fibrous cord, and the fastening means is a cleat at the location of the upper pin, around which the end of the strap is wrapped.

Figure 12:
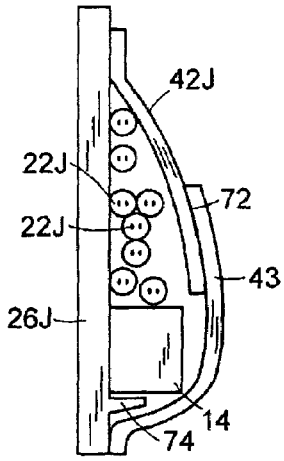
FIG. 12 is a view like FIG. 4, showing a bracket with a two-piece strap which holds an outlet strip in place as well as cords running to the outlet.

In FIG. 12, the strap is in two portions, upper part 42J and lower part 43. One end of each strap parts is attached to the bracket 26J, as by being adhesively or otherwise bonded, or by fasteners, etc. The free ends are connected to each other by detachable fastening means 72.

Such means may be a hook and loop type fastener or a separable pressure sensitive adhesive. Straps may be run from points on the bracket above the strip, as shown in FIG. 7. Preferably, they are run as shown in FIG. 12, where the lower end of strap part 43 is attached to the bracket beneath the outlet strip 14. Thus, the strap helps holds the outlet strip in place. The outlet strip may be mounted on the headed pins as mentioned above; or the strip may be simply captured in place by the strap with help from optional ledge 74 which cantilevers from bracket 26J.

In another embodiment, the apparatus is much like that shown in FIG. 12. In particular, the ends of the upper and lower strap parts are made of a stiff elastically deformable material, for example an acrylic plastic or a metal, such that the free ends of the strap parts lack fastening means. Instead, the stiffness of the strap parts holds them in proximity to each other and to the surface of the bracket. The ends may overlap as shown, or they may be slightly spaced apart from each other. In this embodiment only wires, and not the outlet strip also, may be captured between the strap parts and the surface of the bracket.

While the invention is described for, and will be most useful with, outlet strips which have a multiplicity of linearly spaced apart outlets, in the generality of the invention an outlet strip may have only one, and not a plurality of outlets. The invention may be used for outlet strips which are other than long and narrow, for instance which are square, in overall shape. Thus, the word "strip" in "outlet strip" should not be taken as limiting. When the outlet strip is relatively small or the bracket width approaches the width of the strip, the invention may comprise only one bracket and associated strap. While the invention has been described in terms of electrical devices, the invention may be analogously carried out with optical devices and light beam transmission.

In still another embodiment of the invention, a pair of brackets and associated straps as described may be used without attachment of an outlet power strip. In such embodiment, the brackets may be separate unattached elements which are separately fastened to a surface or they may be attached to each other by means analogous to an outlet strip, for instance by an interconnecting plastic member nominally lying in the plane of the rear face of each bracket.

While the invention has been described in terms of apparatus, it also comprises a method as follows: The method of organizing a plurality of electrical cords, the terminal ends of which run from an electric outlet strip having a rear side with slot openings which comprises:

providing first and second brackets, each bracket having a first projecting member, for engaging one of the slot openings of the outlet strip; fastening each bracket to a vertical surface in spaced apart fashion; mounting the outlet strip by means of said slot openings on said first projecting members, to thereby support the outlet strip, wherein a portion of the each bracket is left exposed and transversely extending from the outlet strip; running the cords back and forth across the exposed bracket surfaces and through the space between the brackets; and running an elastomeric strap from the first projecting member of each bracket and fastening the strap to the end of the exposed bracket portion, to thereby press the cords against the exposed brackets and hold them in place relative to the outlet strip.

The invention is easy and inexpensive to manufacture. It allows one to organize his or her power cords and cables by stringing the cords and cables between the spaced apart brackets. The cable organizing apparatus can work with a variety of makes and models of power strips surge protectors, and other strip outlet devices. The apparatus can be used to secure excess lengths of cords which do not run from the outlets, but connect to other things. With the invention, cables and wires look neater. They present fewer hazards for anyone, including small children, with respect to tripping, entanglement, or pulling electric devices off table tops.

Although this invention has been shown and described with respect to a preferred embodiment, it will be understood by those skilled in this art that various changes in form and detail thereof may be made without departing from the spirit and scope of the claimed invention.

I claim:

1. An electric cord organizing apparatus comprising:

an outlet strip having an oblong shape and a front having a plurality of outlets for receiving the terminal ends of electric transmission cords;

a first bracket and a second bracket, spaced apart from each other and attached to the outlet strip, each bracket extending transversely from at least one side of the outlet strip;

a first strap and a second strap, each strap associated with one of the brackets, for holding cords in proximity to the transversely extended portion of each bracket, each strap running along the transversely extended portion of the bracket, for holding in proximity to the surface of the bracket one or more cords which run to the outlets; and, first means and second means, associated with each bracket and strap set, for fastening the strap; the first means located on the transversely extended portion of the bracket and spaced apart along the bracket surface from the outlet strip; and, the second means located in proximity to the outlet strip.

2. The apparatus of claim 1 wherein said second means for fastening the strap also attaches the bracket to the rear of the outlet strip.

3. The apparatus of claim 2 wherein said second means comprises a headed pin projecting from the bracket, said pin engaged with a slot on the rear of the outlet strip.

4. The apparatus of claim 1 wherein said first means is a member projecting from the surface of the bracket.

5. The apparatus of claim 1 wherein the first fastening means and second fastening means are members projecting from the surface of the bracket, for removably engaging the strap.

6. The apparatus of claim 1 wherein at least one strap is comprised of elastomer.

7. The apparatus of claim 6 wherein the strap is an o-ring.

8. The apparatus of claim 1 wherein the brackets are substantially flat and rectangular plates.

9. The apparatus of claim 2 wherein at least one of the first fastening means and second fastening means of each bracket enable the strap to be detached and reattached to the bracket, so that cords can be thereby captured and released from beneath the associated strap.

10. The apparatus of claim 1 wherein the outlet strip is permanently attached to each bracket; and, wherein said second means for fastening the strap is on the surface of the bracket adjacent to the outlet strip.

11. The apparatus of claim 1 wherein at least one bracket extends transversely in opposing directions from both sides of the outlet strip.

12. The apparatus of claim 11 wherein each bracket extends transversely from opposing sides of the outlet strip, further comprising: third fastening means located upon the surface of each bracket at a point spaced apart from the outlet strip, said third fastening means located on the opposite end of the bracket from the first fastening means.

13. The apparatus of claim 1 further comprising: at least one additional bracket having first and second means for fastening a strap, positioned between the first and second brackets; and an associated third strap.

14. The apparatus of claim 1 wherein at least one of the straps is comprised of inelastic material.

15. The apparatus of claim 1, wherein the brackets are attached to a planar surface, further comprising: a plurality of electric cords running to electrical devices, the cords having terminal ends inserted into the outlets of the outlet strip, wherein at least two of the cords run back and forth transversely between the spaced apart brackets, the cords held in proximity to the surface of each bracket by the strap associated with the bracket.

16. An electric cord organizing apparatus comprising:

an outlet strip having rigid case and at least one outlet for receiving the terminal ends of electric transmission cords;

a first bracket, attached to the outlet strip, the bracket extending transversely from at least one side of the outlet strip;

a first strap, running along the transversely extended portion of the bracket, for holding cords in proximity to the surface of the bracket one or more cords which run to the outlet strip; and, first means and second means, associated with the bracket and strap set, for fastening the strap; the first means located on the transversely extended portion of the bracket and spaced apart along the bracket surface from the outlet strip; and, the second means located in proximity to the outlet strip.

17. The apparatus of claim 16 further comprising a second bracket and second strap, like the first bracket and first strap, the second bracket spaced apart from the first bracket; the second bracket attached to the outlet strip.

18. A kit for organizing a plurality of electric cords, the terminal ends of which run from an electric outlet strip having a rear with slot openings for mounting, which comprises:

at least two brackets; wherein each bracket has spaced apart first means and second means for fastening of a strap to the bracket, the first means located at a first end of the bracket; the second means comprising a headed member projecting from the surface of the bracket, the headed member shaped for engaging a slot opening of an outlet strip after a strap is first fastened to the headed member;

at least two elastomer straps, each strap for running along the length of one of said brackets from the first fastening means to the second fastening means, for resiliently holding cords in proximity to the surface of the one bracket; and, means for attaching the brackets to a planar surface with a spacing between the brackets selected by the user.

19. The kit of claim 18 further comprising: an outlet strip having an oblong shape and a front having a plurality of outlets for receiving the terminal ends of electric cords, the outlet strip having a rear with at least two spaced apart slot openings, each opening shaped for receiving a headed members of one of said brackets.

* * * * *